US006994052B1

(12) United States Patent
McMullen

(10) Patent No.: US 6,994,052 B1
(45) Date of Patent: Feb. 7, 2006

(54) DOUBLE ICON PAGE MARKERS AND METHOD OF PAGE MARKING

(76) Inventor: Laura Ellen McMullen, 607 Raintree Dr., Alexander City, AL (US) 35010

( * ) Notice: Subject to any disclaimer, the term of this patent is extended or adjusted under 35 U.S.C. 154(b) by 0 days.

(21) Appl. No.: 10/993,441

(22) Filed: Nov. 22, 2004

Related U.S. Application Data

(60) Provisional application No. 60/523,995, filed on Nov. 21, 2003.

(51) Int. Cl.
*B42D 9/00* (2006.01)
*B42F 21/06* (2006.01)

(52) U.S. Cl. ..... 116/235; 116/234; 281/42; 283/38; 40/641

(58) Field of Classification Search ..... 116/234–240; D19/32, 34; 281/42; 283/36–43; 40/6, 40/359, 360, 641, 658, 666
See application file for complete search history.

(56) References Cited

U.S. PATENT DOCUMENTS

| | | | | | |
|---|---|---|---|---|---|
| 399,417 | A | * | 3/1889 | Lane | 116/236 |
| 1,713,633 | A | * | 5/1929 | Waream | 40/666 |
| D135,551 | S | * | 4/1943 | Scott | D19/2 |
| 2,415,248 | A | * | 2/1947 | Kenna et al. | 40/641 |
| 2,717,572 | A | * | 9/1955 | Kingman | 116/236 |
| 3,583,358 | A | | 6/1971 | Hanson, Jr. | |
| 3,773,250 | A | * | 11/1973 | Phillips | 229/69 |
| 4,907,825 | A | | 3/1990 | Miles | |
| 5,011,189 | A | | 4/1991 | Olson | |
| 5,056,824 | A | | 10/1991 | Olson | |
| 5,103,758 | A | * | 4/1992 | Clark | 116/237 |
| 5,182,152 | A | | 1/1993 | Ericson | |
| 5,249,827 | A | | 10/1993 | Olson | |
| 5,311,835 | A | * | 5/1994 | Knowles | 116/235 |
| 5,332,265 | A | | 7/1994 | Groess | |
| 5,462,783 | A | | 10/1995 | Esselmann | |
| 5,518,273 | A | | 5/1996 | Olson | |
| 5,632,225 | A | * | 5/1997 | Krasner | 116/235 |
| 5,641,182 | A | | 6/1997 | Schwandt | |
| 5,911,442 | A | | 6/1999 | Olson | |
| 6,013,154 | A | | 1/2000 | Thomas-Cote | |
| 6,149,202 | A | | 11/2000 | Anzai | |
| 6,244,628 | B1 | | 6/2001 | Muller | |
| 6,257,623 | B1 | | 7/2001 | Fero | |
| 6,349,970 | B1 | | 2/2002 | Fero | |
| 6,435,967 | B1 | | 8/2002 | Michlin | |
| 6,526,906 | B1 | | 3/2003 | Bidanset et al. | |
| 6,550,417 | B2 | * | 4/2003 | Hendershot | 116/234 |
| D483,405 | S | | 12/2003 | Bratter et al. | |
| 6,671,987 | B1 | * | 1/2004 | Fenton | 40/6 |
| 2003/0151245 | A1 | | 8/2003 | Levine | |
| 2003/0178840 | A1 | | 9/2003 | Bidanset | |

* cited by examiner

*Primary Examiner*—R. Alexander Smith
(74) *Attorney, Agent, or Firm*—Donald Grant Kelly

(57) ABSTRACT

A marker and method of marking pages for subsequent revisit in accordance with a predetermined theme such as wedding, birthday or holiday gifts, home décor ideas and so forth, wherein the marker includes primary and a secondary icon designs to be positioned one behind the other on strips that include a tacking agent. The primary icon design is detailed and/or colorful, while the secondary is faded and/or without color, yet remaining evocative of the primary. When placed on open pages, the primary icon faces the user, but when the pages are closed the result is that the primary icon indicates right page placement while the secondary indicates left page placement. This will help the user to differentiate placement of a marker on a right page from a left page within the book, magazine, catalogue or the like and thus facilitate accurate identification of the flagged page.

13 Claims, 2 Drawing Sheets

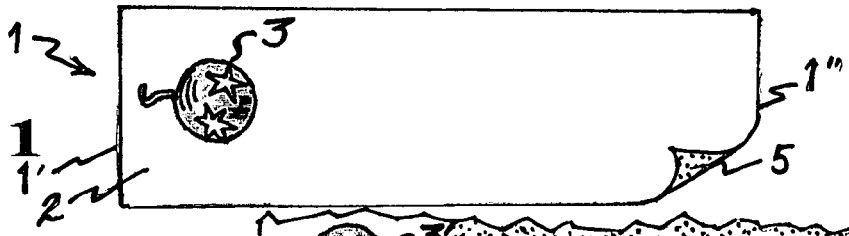
Fig. 1
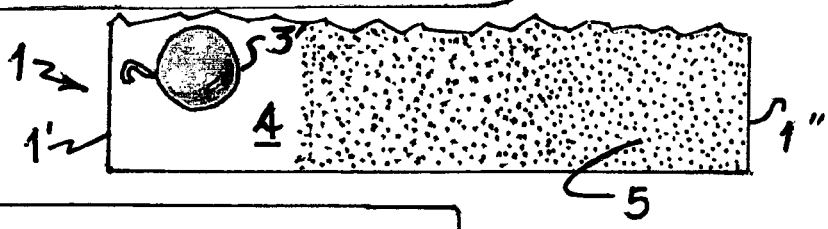
Fig. 1-a
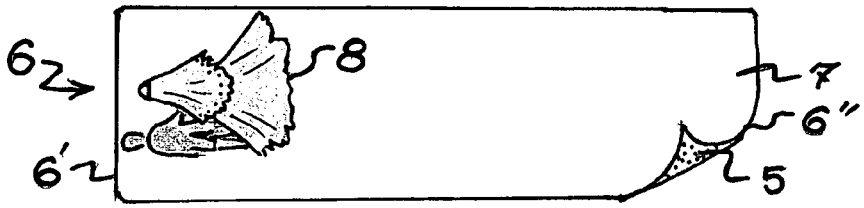
Fig. 2
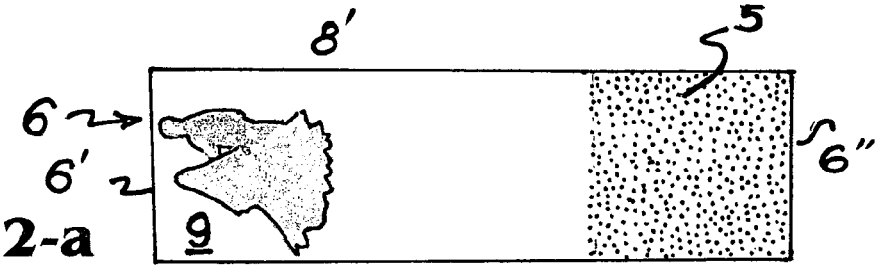
Fig. 2-a
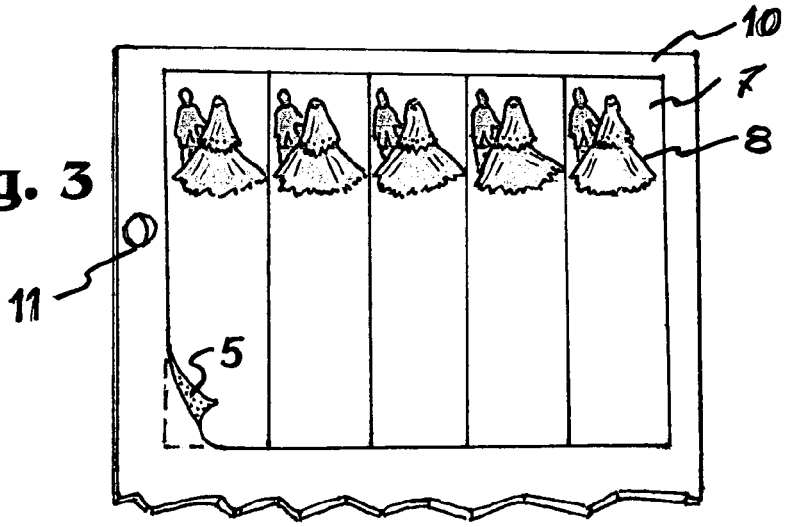
Fig. 3

Fig. 4-a
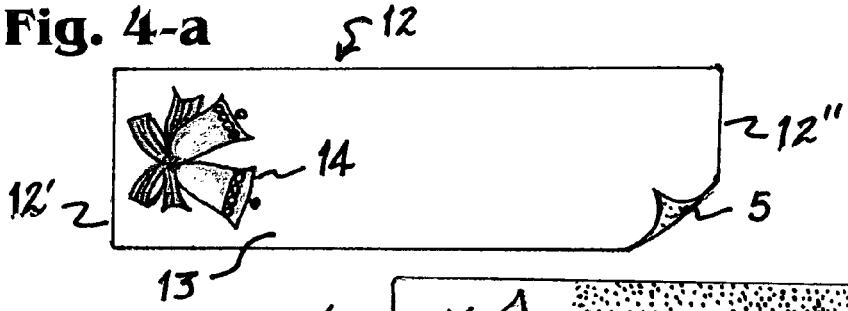
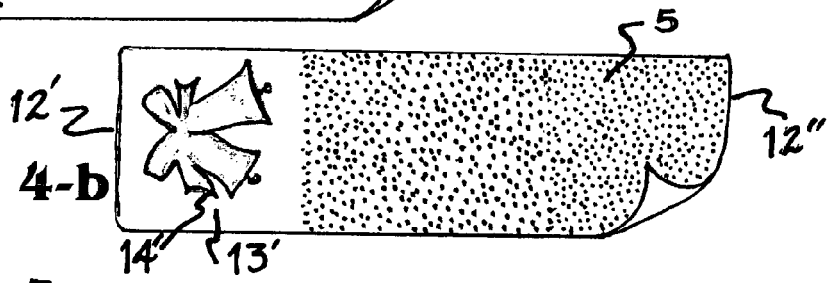
Fig. 4-b
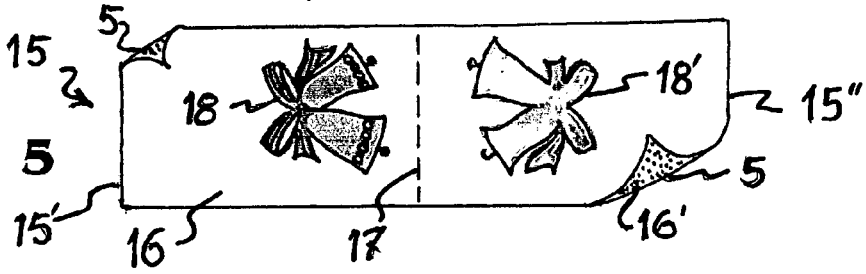
Fig. 5
Fig. 6-a
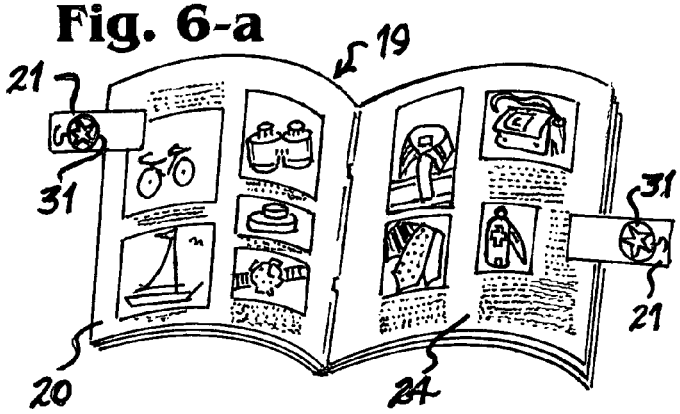
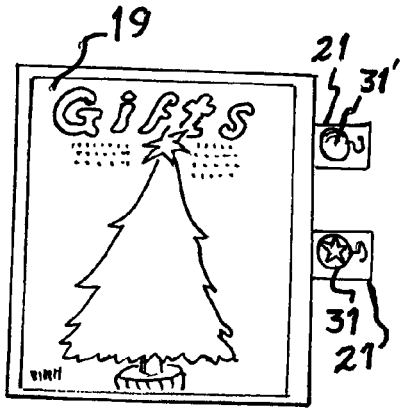
Fig. 6-b

DOUBLE ICON PAGE MARKERS AND METHOD OF PAGE MARKING

REFERENCE TO RELATED APPLICATIONS

This application claims all priority benefits under 37 CFR 1.119 for provisional patent application No. 60/523,995 filed Nov. 21, 2003, hereby incorporated by reference in its entirety.

STATEMENT REGARDING FEDERALLY SPONSORED RESEARCH OR DEVELOPMENT

Not applicable

REFERENCE TO SEQUENCE LISTING

Not applicable

BACKGROUND OF THE INVENTION

The present inventive device and method relates to the general field of indicators, particularly those indicators that signal a position or location through human senses such as sight and touch. More specifically, the invention is concerned with placement of markers within text and pictorial material, and the like, marking one or more pages for subsequent identification and recall. The present invention is particularly applicable, though not intended as limited, to catalogues, magazines, text books, songbooks, trade journals, and so on.

For many years, perhaps even centuries, people have felt the need to keep track of certain pages of books and magazines, and the like, for later recall. They have done this through a variety of means and methods. Most commonly, such efforts have included the well-worn "dog-ear" method where a portion, typically a corner, of a page of interest is turned or folded inwardly. This, of course, does the job of temporarily marking a page, but it has unwelcome consequences.

A dog-eared page is often permanently deformed. This is not a good thing if the book or magazine is on loan, as from a public library or commercial enterprise (for example, catalogues of pages representing wedding gowns or collections of interior décor layouts). Besides, the folded page corners are not visible from a general inspection of the book or magazine. Thus, to revisit a previously marked page requires a close look at the book or magazine edges, or an exercise in page-flipping, to discern their existence and location.

Another popular way of temporarily marking page locations is through the use of strips of paper or other material torn or cut from any convenient material (often a magazine subscription insert, napkin, or matchbook cover). Such markers are unsightly, of course, and fairly unreliable in that they are easily dislodged and may slip deeply within the book or magazine periphery or even fall away to become permanently lost.

A number of other temporary markers have evolved over the years, including the application of plastic tape (e.g., Scotch Tape®) or other adhesive strip material. Also called into play are the well-known paper clips, and a range of other metallic clips, plastic and cardboard dividers, or the glued-on edge-marking tabs, all of which may tear and deform the pages to which they are applied. Besides, these items are neither inexpensive nor readily available when needed.

Thus, a variety of alternatives have evolved, particularly in the wake of the development of temporary tacking agents in the form of non-aggressive adhesive substances. The emergence of such flagging implements as Post-It Notes® and other similar tacky tabs and markers has given birth to a vast variety of forms and formulations of page indicators and marking methods. These have included specially shaped tabs or marker flags, theme oriented flags, and readily dispensed flags or marking tabs. The patent literature reflects these developments, as will be discussed herebelow.

Esselmann, in U.S. Pat. No. 5,462,783, discloses indicia-bearing tabs or labels contained within a dispensing sheet for incorporation within a book such as a telephone directory, dictionary or the like. Esselmann's tabs, releasably secured to a thin backing sheet, may be applied to book pages to designate various alphabetical headings, sub-headings, categories or divisions and so on.

The facing sheet and liner described in Esselmann's patent have overlying, extended edges for binding the label dispensing sheet proper within the book with corresponding portions of these extended edges being die cut and perforated, respectively, to form a lock and release construction holding the sheet securely in place in the book while permitting its ready removal therefrom during tab assembly to the book pages.

Esselmann's labels or tabs have extended right and left halves for adhesively contacting opposite sides of the book pages. The labels or tabs are separated one from another by a scored center or crack line to insure ready, accurate folding of the labels during assembly to the book pages. The labels have edge markings such as dashes for aligning the labels with the edges of the book pages during assembly so as to insure the labels or tabs have a uniform projection therefrom for ease of visibility and to present an extension suitable for gripping contact by the book user in turning to a desired section of the book.

In U.S. Pat. No. 5,641,182, inventor Schwandt presents an information relocating system comprising an indexing apparatus with a wide range of uses. Schwandt's preferred embodiment comprises a central index with an index portion and a marking portion printed on a layer of sheet stock with adhesive backing.

Schwandt's markers are die-cut from the same layer of sheet stock as the central index and have unique identifiers corresponding to unique identifiers on the marking portion of the central index. The markers and the central index are completely severed from each other and held adjacent by their mutual releasable attachment to a common backing sheet.

A portion of Schwandt's backing sheet is removable to allow attachment of the device to a document or other surface, the remaining portion serves to hold the markers adjacent to the central index. In one embodiment, Schwandt's central index and the markers are initially printed on the same layer of substrate, such as sheet stock coated with a permanent adhesive of the type used in Avery® labels, or temporary adhesive such as that used on Post-it Notes®.

In Ericson's U.S. Pat. No. 5,182,152 Ericson, a label dispensing sheet is described as including a backing sheet having a layer of a pressure sensitive adhesive releasing material on one face and a weakened line across its width, a row of adhesive labels releasably disposed on the backing sheet overlying the weakened line, and a release strip releasably disposed on the backing overlying the weakened line.

Ericson goes on to describe the release strip as having a weakened line at a position offset from the weakened line in the backing. This permits a user to grasp and pull away the release strip, exposing the ends of the labels for easy removal. The labels may, for example, be thin, plastic index tabs for labeling book pages.

In U.S. Pat. No. 6,244,628 issued to Muller, the inventor discloses a text tabbing system and method, which provides a Bible topic referencing system and method. The system and method employ adhesive-backed tabs to locate Bible verses corresponding to various pre-selected topics found in the Bible. The tabs are arranged in linear rows corresponding to a topic and picture icons are contained on the tabs and correspond to the various pre-selected topics.

In Olson's U.S. Pat. No. 5,518,273, (henceforth, '273) the inventor discloses a single or multi-functional reference marker apparatus for paginated and non-paginated publications, portfolios and other supporting substrates. The reference marker apparatus having one or more other applications as receptacle marker, index marker, game marker and coupon marker and may carry subordinate reference marker(s).

Olson's ('273) apparatus consisting of at least one reference marker is formed from multi-faced substrate including the support/covering substrate(s) which may be articulated and/or non-articulated to the reference marker or markers. Each reference marker has at least one attaching area on at least one face of at least one mounting portion of the multi-faced substrate.

In Olson's U.S. Pat. No. 5,249,827, ('827) the inventor describes a reference-aid article to be used as an index marker, game marker, or coupon marker. The reference-aid is formed from a multi-faced substrate which is adapted to accept information on at least one of the faces. The substrate also has at least one marker member and at least one removably protective substrate means releasably attached to the substrate. Olson, in U.S. Pat. No. 5,911,442 ('442), and U.S. Pat. No. 5,011,189 ('189) shows various arrangements including identifier tabs associated with an index or menu. The tabs and index may be manufactured along with the publication.

U.S. Pat. No. 5,056,824, ('824) issued to Olson, discloses a reference-aid publication supplement that comprises at least one marker member which may be a marker panel portion supplied with a publication for the purpose of indexing so as to rapidly retrieve and access publication information contained therein. Each marker member may be formed or shaped from double-faced flexible sheet substrate unitarily or independently therefrom by at least one line of separations, severable line means, separable line means.

Olson's patent ('824) further discloses that one face of each marker member has at least one predetermined attachment area with one or more flexible adhesive layer attached thereto and covered by a removable protective sheet means. A non-aggressive, low adhesion adhesive of a releasable and reusable pressure sensitive type permits the markers to be re-mountable.

Bidanset, in U.S. Patent Application No. 20030178840, and in U.S. Pat. No. 6,526,906, teaches a page marking device that is part of a book. Specifically, the book has a tab assembly carrier with a plurality of removable tabs disposed on the carrier. A printed indicium is located on each of the tabs. The tabs are secured to the carrier by a non-aggressive adhesive allowing the tabs to be removed from the carrier relocated and/or removed again as required by the user of the device. Printed indicia may also be located on or beneath said carrier.

U.S. Patent Application No. 20030151245 filed by Levine discloses an advertising apparatus and method utilizing a sheet of pre-cut removable and repositionable page marking stickers to be inserted into a magazine or other publication. The individual page markers can selectively include advertisements printed on the bottom surfaces of the markers, which include adhesive, as well as on the sheet surfaces underlying the page markers.

Levine further shows advertisements printed on the underside of a page marker (including under the adhesive) and on the associated portion of underlying sheet which may directly or indirectly relate to or correspond to one another. These are exposed when the marker is peeled from the underlying sheet to mark a page of interest in the magazine for later reference. The advertisement on the marker is highly visible when the marker is used to mark a page. The advertisement on the exposed underlying sheet is visible whenever that page is open.

U.S. Pat. Nos. 6,257,623 and 6,349,970, both issued to Fero, present a printed publication having integrated labels or bookmarks, as well as a method for manufacturing same. The printed publication includes a plurality of pages and a cover, at least one of which includes a plurality of bookmarks releasably adhered thereto. The bookmarks can be individually removed by the user, and repositioned elsewhere within the publication for marking and later reference purposes. The method includes the steps of applying an adhesive coating along a moving web of material, applying a release coating to the moving web, folding the web such that the adhesive coating is adhered to the release coating, and cutting the web into individual labels.

Michlin, in U.S. Pat. No. 6,435,967, discloses a tab marking system for supplying discrete tabs provided with repositionable glue disposed adjacent first terminal ends thereof which may be adhered to multi-page documents to flag particular pages. The tab marking system comprises a first ply of paper having at least two discrete tabs die cut therein separated by a spacer and a second ply of paper disposed under the first ply covering at least a portion of the discrete tabs.

Michlin further describes a barrier coating disposed on said second ply in facing relation to the repositionable glue in order to prevent adhesion of the repositionable glue to the second ply. Embodiments of the invention include an adhering agent disposed on the discrete tabs adjacent second terminal ends thereof to removably hold second terminal ends integral with the first ply of paper until removal of the tabs is desired.

U.S. Pat. No. 5,332,265 issued to Groess concerns an advertising assembly which comprises a paper or polymeric backing layer having opposite major surfaces printed with advertising indicia. The assembly further includes a plurality of sheets each comprising a layer of flexible polymeric material having a coating of repositionable pressure sensitive adhesive on one of its side surfaces on a second end portion adjacent a second end while being free of adhesive on both of its side surfaces along a first end portion. The sheets are releasably adhered in parallel rows to the first surface of the backing layer by the coatings of pressure sensitive adhesive with the sheets in each row being positioned with their side edge surfaces adjacent and with their first end portions aligned, and can be printed with advertising.

Patentee Miles, in U.S. Pat. No. 4,907,825, presents a sheet for temporarily marking portions of documents. The sheet includes an elongate layer of polymeric material that is flexible and includes a repositionable adhesive on one end portion thereof. A second end of the sheet is free of adhesive and is visually distinctive. The sheets may be stacked and provided through a dispenser.

U.S. Pat. No. 6,013,154, granted to Thomas-Cote, provides a computer printer compatible index tab assembly including a carrier sheet recognizable by any of a wide variety of computer compatible printing devices. The carrier sheet includes a plurality of self-adhesively secured tabs each formed from a resilient, durable thin film. The self-adhesive is formulated to either permanently or releasably adhere to a peripheral edge of a sheet of material which is to be tagged, labeled or indexed. After printing, the index tab is transferred from the carrier sheet and positioned with the self-adhesive securing the index tab to the sheet of material and with the indicia projecting outwardly from the edge for convenient display.

Bratter, in U.S. Pat. No. D483,405, illustrates an ornamental design for a sheet with removable flags. Anzai, in U.S. Pat. No. 6,149,202, discloses a page marker carrier assembly which is a unit for transporting a page marker which allows a consumer to open the assembly and remove the page marker and position the marker onto a page of a catalogue.

In U.S. Pat. No. 3,583,358, patentee Hanson, Jr. illustrates a detachable marker tab for temporarily calling attention to a particular portion of a page of a book or other document, the tab being in the form of an elongated strip shaped at one end in the form of a pointer and coated over a portion including the pointer with a pressure sensitive adhesive that allows the marker to be removed without damaging the page. Further described is a retainer for a set of detachable markers.

Despite the highly evolved stage of book marks and magazine flags, there remain certain shortcomings. Chief among these is the lack of easy identification of the exact page being designated or indicated by a flag or tab. For example, when such markers are placed between pages of a book and attached or adhered to a page edge so as to extend outwardly therefrom, they may be placed either on a left page or a right page. Most often, the user applies his or her own convention that places every tag or flag upon the right-side page. When closed, the book or magazine displays all such tags in the same manner. Subsequent access to pages saved or marked in this manner is too often unguided as to whether the right or left page was intended for marking.

Of course, when flags, tabs, markers or tags are temporarily adhered to both page sides (right and left), the issue of which page is designated obviously is resolved. However, the currently available markers for such designation still have shortcomings. This is particularly true where a theme marker is utilized or where a marker is intended to relate to a specific individual or other reference point.

In such cases, as is known in the prior art, icons or indicia are placed on one side of the markers (typically at or near one end thereof for display such that their viewing evokes an intended reference (category, person, and so forth). When the book, magazine or catalogue is in its closed mode, many of the markers will be indistinguishable, since some are then viewed at their reverse (e.g., having been placed on a left page surface and thus having its view reversed on closing the book, magazine or catalogue). The present inventive device and its method of use effectively resolve these and other shortcomings existing in the art.

BRIEF SUMMARY OF THE INVENTION

The principal object of the invention described below is to provide a new and improved method and device for marking or designating pages of a book, magazine, catalogue and the like for subsequent revisit. A further object is to provide a flagging device and its method of use that are simple and reliable in application.

A still further object is to provide a device and method for flagging (for recording or revisit) specific pages that avoid user confusion as to which of two adjacent pages (right or left) are intended designees. Another object is to provide a method and device of page marking that will result in a user's instant association of a page, designated with specifically decorated tabs, flags and markers, to a reference point or person. Also, this invention will facilitate the user instantly knowing which page (left side or right side) the marker is mounted after the book, magazine, catalogue or the like is closed (and even when stacked with other books and so forth).

Still another object is to provide a unique marker design to include thereon dual decorative designs or insignia which serve to identify, respectively, left or right side pages among adjacent pages. Yet another object is to present a simple device and its method of use whereby said dual designs or insignia placed as a set on a flag, tag, tab, or other page marker differ within a set, one from the other. In other words, each marker carries a primary and secondary insignia for further facilitating recognition and association of said markers when the book, magazine, catalogue or the like is closed, as is further detailed herebelow.

Other objects, features, and characteristics of the present invention will become apparent upon consideration of the following full description, and with reference to the accompanying drawings, wherein like reference numerals or characters indicate corresponding elements in the various figures.

BRIEF DESCRIPTION OF THE SEVERAL VIEWS OF THE DRAWINGS

Referring now to the accompanying drawings, constituting a part hereof, it is seen that:

FIG. 1 illustrates in a plan view of a marker tab, tag, or flag (henceforth referred to as a marker) in accordance with the present invention, and with one end curled upward so as to sample its obverse side;

FIG. 1-*a* presents a partial (broken) plan view of a portion of the marker illustrated in FIG. 1;

FIG. 2 shows a plan view of another marker embodiment similar to that illustrated in FIG. 1, and again with one end curled slightly to afford a view of a portion of its obverse side;

FIG. 2-*a* shows a plan view of the obverse side of the embodiment of the present invention illustrated in FIG. 2;

FIG. 3 illustrates a set or collection of markers mounted for removal from a substrate;

FIG. 4-*a* shows the plan view of still another form of marker in accordance with the present invention, again with a curled portion to show an underside thereof;

FIG. 4-*b* illustrates a plan view of the underside or reverse side of the marker shown in FIG. 4-*a;*

FIG. 5 illustrates a plan view of another embodiment of the same marker device and its method of use, but showing opposite ends thereof curled up slightly to reveal the opposite side thereof;

FIG. 6-*a* shows a perspective view of a book, magazine, catalogue or the like with the inventive marker applied in accordance with the present invention;

FIG. 6-*b* illustrates a plan view of the book, magazine, catalogue or the like of FIG. 6-*b* in a closed position.

DETAILED DESCRIPTION OF THE INVENTION

With reference to FIG. 1, marker 1 is presented in accordance with the present invention. In the form illustrated, the marker is seen to comprise an elongated form with a first and second end (respectively designated as 1' and 1"), though a variety of shapes may be employed within the scope of the invention described. Marker 1 may be fabricated from a variety of materials selected from the group consisting of paper, polymer, pressed fibers and combinations thereof. The first side 2 (henceforth referred to as the primary side) of the marker 1 carries a first indicium or icon design 3 (henceforth referred to as a primary icon design). Design 3 is located at or near the end 1' of marker 1.

FIG. 1-*a* illustrates the second side (or obverse, or reverse side) of marker 1. On a second side 4 of marker 1 at a location at near end 1' thereof is located a second indicium or icon design 3' (henceforth referred to as a secondary icon design). In the example illustrated, the icon design connotes a holiday theme, and could be an icon representative of a specific person for whom a gift is designated. Also located on the second side 4 of marker 1 is a partial coating of a low aggression, repositionable pressure sensitive adhesive (henceforth referred to as tacking agent) 5. This partial coating is located near the end 1" at least, but may also extend nearly to said second icon design 3'. In the embodiment shown, and purely as an example, the tacking agent 5 covers around three quarters of the second side 4.

In keeping with the spirit and scope of the present invention, said secondary icon design 3' is intentionally presented as being similar in appearance to primary icon design 3, yet dissimilar in at least some respect. For example, as illustrated, secondary icon design 3' is seen as merely an outline or faded version of the primary icon design 3, and clearly lacking details or clarity.

Differences between marker icon design 3 and design 3' may be based on color or shade, where for example design 3 may be in full color while icon design 3' may be presented in grayscale. Further, the icon design 3 may include esthetic or artistic details (consistent with a theme or a point of reference, meaning that the icon design is associated with a particular person or event). Icon design 3', on the other hand, would be substantially free of detail, except that it would vaguely retain a resemblance so as to be merely evocative of the theme or reference point. In the example illustrated, icon design 3' is shown as the reverse image (or mirror image) of icon design 3. These and any of a vast variety of other differences may be applied, as long as the secondary icon design remains evocative of the primary design so as to be recognized by a user as associated therewith.

FIG. 2 illustrates a similarly detailed example of the present invention but in this instance is presented relative to a wedding theme. This might represent markers for designating wedding gowns featured within a variety of gown magazines or catalogues. Marker 6, with its first end and second end, 6' and 6" respectively, includes icon design 8 on first side 7 and an evocative icon design 8' on second side 9, both at or near end 6'.

Again, a tacking agent 5 is located at or near end 6" and shown, for example only, as covering only about one quarter of side 9. In this case, design 8' is seen as an outlined representation of icon design 8, and lacks a number of details of icon design 8. Yet, there would be no doubt from the user's perspective that the two are thematically related.

As illustrated in FIG. 3, said markers (for example marker 7) may be supplied and stored on a backing sheet 10 suitably formed of any suitable substrate and with a substrate surface from which the tacking agent 5 will easily release. In the embodiment illustrated as an example, a thematic set could relate to a wedding as indicated by icon design 8. Other icon design sets could relate to interior design, recipes, gardening, wine, sports, hobbies and so forth (not shown); alternatively, the icon design may reference intended recipients of gifts from a catalogue of garments, toys or other merchandise to be discussed below. The substrate may be suitable hole-punched 11 for storage in a ring-type binder (not shown).

As is known in the prior art, the substrate-mounted marker set represented by example in FIG. 3 may be marketed as a premium or accessory supply, or may be furnished as part of a multi-theme kit. Optionally, this type of market set or may be incorporated into a catalogue or magazine, even packaged therewith or physically attached within a catalogue cover.

The embodiment illustrated in FIG. 4-*a* shows marker 12 with ends 12' and 12" and first and second sides 13 and 13'. The primary icon design 14 located on surface 13 also follows a holiday theme as in FIG. 1. The reverse side 13' of marker 12 is shown in FIG. 4-*b*, with a secondary icon design 14' near the end 12'. In FIG. 4-*b*, the tacking agent 5 is illustrated, again for example only, as extending from an area near to secondary icon design 14' nearly to the end 12". Again, it should be noted that the secondary icon design 14' is merely an evocative impression of design 14.

In FIG. 5 primary and secondary icon designs 18 and 18' are positioned on first side 16 and of marker 15 so as to be distanced from the respective ends 15' and 15" thereof. As will be apparent in this illustration, icon designs 18 and 18' are placed toward an imaginary center line indicated by dashed lines 17. For illustration purposes, curled-up ends 15' and 15" show the location of a coating of tacking agent 5, which may extend the full length notably at or near said ends. In this, and every instance where a tacking agent is shown, it should be noted that the tacking agent coating need not be continuous, but may be presented in a discontinuous pattern such as stripes or polygonal shapes, for example.

Similar to the application of the earlier embodiments, marker 15 may be folded and pinched onto a page edge so as to designate a specific page for revisit. The user will follow a convention when placing said marker so as to ensure that the secondary icon design will face toward the front when the book, catalogue or magazine is closed. Of course, within the scope of the present inventive device and method, the opposite convention may be selected (wherein the secondary icon design will face downwardly or away from the front when the book is closed) so long as it is followed consistently.

Illustrating the use of the inventive method and device, FIG. 6-*a* shows an open gift catalogue 19 where a marker 21 with primary icon design 31 associated with a reference point such as a prospective gift recipient is applied to both the left and right page surfaces, 20 and 24 respectively. In each instance, the marker is placed with primary icon design in a "face up" mode. When closed, as shown in FIG. 6-*b*, it remains apparent that one of the markers has been placed on a left surface, the other on the right. This is because one of the markers displays a secondary icon design 31'. If these markers had been located in different sections of the catalogue, and if different markers carried icon designs that referenced other prospective recipients, this information would be very useful. The quick and accurate location of correct pages, associated with the correct reference points would avoid confusion, frustration and delays.

Thus, a unique and novel solution is presented to the problems of marking pages for easy revisit, and for associating certain pages and the items or information displayed thereon to reference points in a convenient and accurate manner.

In its application, the user may, for example, select a theme such as wedding gowns. A set of markers are provided that relate to the general theme of a wedding. Other sets may refer to flower arrangements or bridesmaid dress designs, tuxedos, suggested flower arrangements and so on. Each marker within said sets is provided with primary and secondary indicia icon designs, along with a partial coating of a releasable tacking agent.

As the user reviews one or more wedding catalogues with multiple displays of gowns, bridesmaid dresses, and a selection is designated as being of interest, an appropriate marker is removed from its set and place at the edge of the catalogue in position such that its icon design extends outwardly from an edge of thereof (this could be the top, bottom or side edge). If the selection is on the right page, the marker is placed such that it will be viewed as a primary icon design when the catalogue is later closed; if on the left, the marker is placed such that it will be viewed as a secondary icon design when said catalogue is closed. At the time of placing the markers, each will be placed such that the marker is viewed by the user as a primary icon design. This convention may be reversed of course, as long as consistently followed.

As floral arrangements or bridesmaid dresses and so forth are identified as being of interest, different icon designs may be selected and applied so as to refer to the different item selected. In this case, the same convention will be followed. The result is that the users will not be confused as to which item is referred to on which page, and for what reason.

As suggested in FIG. 6-*a* and 6-*b*, the application of this inventive device and method is particularly useful when selecting gifts for a number of prospective recipients. Each recipient could be represented by his or her own icon design, with the theme being a holiday, birthday, graduation and so forth. The gift catalogue, when all selections are indicated, may have a great number of markers attached thereto, and extending outwardly from the various pages therein. This unique device and method for the first time afford a quick and easy way of determining left and right page placement at a glance when the catalogue is still closed, facilitating quick and accurate revisit.

Upon careful review of the foregoing specification and drawings, it will be evident that this invention is susceptible of many modifications, combinations and alterations which may differ from those specifically set forth. The particular arrangements disclosed are meant to be illustrative only and not limiting as to the scope of the invention which is to be given the full breadth of claims appended hereto and any and all equivalents thereof.

What is claimed is:

1. A marker for flagging a page of a magazine, catalogue, book or the like for revisit, and of the type including a member having a first and second side, with at least one side further including a repositionable pressure sensitive adhesive, and adapted to be applied to a left or right hand page of said magazine, catalogue, book or the like, the improvement comprising:

said marker having a first icon design located on one of said first and second side thereof;

said first icon design being a unique primary image related to a reference point;

said marker having a second icon design positioned on one of said first and second side of said marker;

said second icon design being a unique secondary image similar in appearance yet different from said primary icon design, and also related to said reference point;

whereby said marker may be selectively applied to an open right or left page in such a way as to indicate, when said magazine, catalogue, book or the like is closed, the right or left location of said marker, due to the difference in the primary and secondary icon design.

2. The marker of claim 1 wherein the primary icon design and secondary icon design are similar in shape, while said primary icon includes a unique color.

3. The marker of claim 1 wherein the primary icon design and secondary icon design include a common image, said secondary icon design is a faded version of the primary icon design image.

4. The marker of recited in claim 1 and further defined as:

said primary icon design is located on said first side of said marker adjacent a first end thereof;

said secondary icon design is located on said second side of said marker adjacent said first end thereof;

said temporary tacking agent is located on said second side of said marker;

whereby, when said magazine, catalogue, book or the like is dosed, a marker placed on a right hand page will reveal to the user its primary icon design, and a marker placed on a left hand page will reveal its secondary icon design.

5. The marker recited in claim 1 and further defined as:

said primary icon design and secondary icon design are located on said first side of said marker, and positioned at a location near a central portion of said marker;

said marker including a fold line so as to make a fold at or near its central portion along a line extending substantially between said primary and secondary icon designs, such that said primary and secondary icon designs are on an outer surface of said fold;

said temporary tacking agent is located on said second side of said marker and covering said second side at least adjacent both ends thereof and being inside said fold;

whereby, said marker may be folded at it's central portion so as to be applied to a left or right page edge in a manner such that, when said magazine, catalogue, book or the like is closed, a marker placed on a right hand page will reveal to the user its primary icon design, and a marker placed on a left hand page will reveal its secondary icon design.

6. A method of marking or flagging a page of a magazine, catalogue, book or the like for revisit, and of the type including the steps of providing a flagging member having a first and second side, with at least one side further including a repositionable pressure sensitive adhesive, and applying said flagging member to a left or right hand page of said magazine, catalogue, book or the like, the improvement including the further steps of:

providing said marker with a first icon design located on one of said first and second side thereof;

said first icon design being a unique primary image related to a reference point;

providing said marker with a second icon design positioned on one of said first and second side of said marker;

said second icon design being provided with a unique secondary image similar in appearance yet different from said primary icon design, and also related to said reference point;

whereby said marker is selectively applied to an open right or left page in such a way as to indicate, when said magazine, catalogue, book or the like is closed, the right or left location of said marker, due to the difference in the primary and secondary icon design.

7. The method of claim 6 including the step of providing the primary icon design and secondary icon design in similar shapes, and further providing said primary icon with a uniquely identifiable color.

8. The method of claim 6 further including the steps of:

providing the primary icon design and secondary icon design with a common image;

further providing said secondary icon design with a faded version of the primary icon design image such that said secondary icon image is different yet evocative of said primary icon design.

9. The method of claim 6 further including the steps of:

providing the primary icon design and secondary icon design with a common shape;

further providing said primary icon design with at least one unique color;

further providing said secondary icon design with a non-color appearance.

10. The method recited in claim 6 and including the further steps of:

locating said primary icon design on said first side of said marker adjacent a first end thereof;

locating said secondary icon design on said second side of said marker adjacent said first end thereof;

locating said temporary tacking agent on said second side of said marker;

whereby, when said magazine, catalogue, book or the like is closed, a marker placed on a right hand page will reveal to the user its primary icon design, and a marker placed on a left hand page will reveal its secondary icon design.

11. The method recited in claim 6 and further including the steps of:

locating said primary icon design and secondary icon design on said first side of said marker, and positioning them at a location near a central portion of said marker;

providing a fold of said marker at or near its central portion along a line extending substantially between said primary and secondary icon designs, such that so as to position said primary and secondary icon designs are on an outer surface of said fold;

locating said temporary tacking agent on said second side of said marker and adjacent both ends thereof and inside said fold;

applying said marker to a page edge in a manner such that it will extend from said page;

whereby, when said magazine, catalogue, book or the like is closed, a marker placed on a right hand page will reveal to the user its primary icon design, and a marker placed on a left hand page will reveal its secondary icon design.

12. A method of flagging items within a catalogue utilizing sets of theme style markers carrying icon designs that relate to different reference points, wherein said marker includes a front side and backside, and with a temporary tacking agent on its backside so as to facilitate ease of removal and reuse as desired, the improvement including the steps of:

providing each of said markers with a pair of icon designs including a primary icon design on said front side and a secondary icon design on said backside;

preparing said designs so as to be common to said theme style and reference points as well as similar in form yet different in detailed appearance, such that said secondary design is merely evocative of said first icon design;

applying said markers to appropriate catalogue pages carrying selected items for flagging, wherein said step of applying said markers includes selectively placing said markers such that, when viewed as extending from said catalogue in its closed position, markers placed on a left page will reveal a different icon design from those placed on a right page;

whereby, the user will easily determine left and right page marker placement at a glance when the catalogue is closed and displaying a number of markers, thus facilitating quick and accurate revisit.

13. The method of claim 12 wherein said primary icon design is distinct and colorful, and said secondary icon design is faded and without color yet similar in form to said primary icon design.

* * * * *